US010971092B2

(12) United States Patent
Chen

(10) Patent No.: US 10,971,092 B2
(45) Date of Patent: Apr. 6, 2021

(54) DRIVING METHOD AND DRIVING DEVICE OF DISPLAY PANEL

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Guangdong (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/632,231

(22) PCT Filed: Sep. 20, 2017

(86) PCT No.: PCT/CN2017/102436
§ 371 (c)(1),
(2) Date: Jan. 17, 2020

(87) PCT Pub. No.: WO2019/015073
PCT Pub. Date: Jan. 24, 2019

(65) Prior Publication Data

US 2020/0234665 A1 Jul. 23, 2020

(30) Foreign Application Priority Data

Jul. 21, 2017 (CN) ..... 201710602429.1

(51) Int. Cl.
*G09G 5/00* (2006.01)
*G09G 3/36* (2006.01)

(52) U.S. Cl.
CPC ..... *G09G 3/3614* (2013.01); *G09G 3/3677* (2013.01); *G09G 2310/0289* (2013.01); *G09G 2310/08* (2013.01)

(58) Field of Classification Search
CPC ..... G09G 3/20; G09G 3/2092; G09G 3/32; G09G 3/3266; G09G 3/3614; G09G 3/3674; G09G 3/3677; G09G 2310/0289; G09G 2310/08
See application file for complete search history.

(56) References Cited

U.S. PATENT DOCUMENTS

| | | | | |
|---|---|---|---|---|
| 9,251,756 | B2 * | 2/2016 | Choi | G09G 3/3677 |
| 9,275,599 | B2 | 3/2016 | Pyun et al. | |
| 2004/0108989 | A1 * | 6/2004 | Gyouten | G09G 3/3677 345/100 |

(Continued)

FOREIGN PATENT DOCUMENTS

| | | |
|---|---|---|
| CN | 102479494 A | 5/2012 |
| CN | 104680991 A | 6/2015 |

(Continued)

*Primary Examiner* — Joe H Cheng
(74) *Attorney, Agent, or Firm* — Muncy, Geissler, Olds & Lowe, P.C.

(57) ABSTRACT

A driving method and a driving device of a display panel are provided. The driving method includes: controlling a timing controller to output a start signal to a level shifter; configuring a parameter of a register of the level shifter; and controlling the level shifter to generate a drive signal according to the parameter upon receiving the start signal, and outputting the drive signal to a first drive circuit.

18 Claims, 8 Drawing Sheets

(56) References Cited

U.S. PATENT DOCUMENTS

| | | | | |
|---|---|---|---|---|
| 2005/0179677 | A1* | 8/2005 | Nojiri | G09G 3/3677 345/204 |
| 2008/0024413 | A1* | 1/2008 | Minami | H01L 27/124 345/90 |
| 2010/0085341 | A1* | 4/2010 | Hasegawa | G09G 3/3258 345/208 |
| 2010/0149167 | A1* | 6/2010 | Hasegawa | G09G 3/3225 345/213 |
| 2010/0188444 | A1* | 7/2010 | Okuyama | G09G 3/3648 345/691 |
| 2012/0075280 | A1* | 3/2012 | Liu | G09G 3/3696 345/212 |
| 2012/0133627 | A1* | 5/2012 | Moon | G09G 3/3648 345/208 |
| 2015/0277657 | A1* | 10/2015 | Azumi | G09G 3/3648 345/174 |
| 2015/0364114 | A1* | 12/2015 | Smith | G09G 3/3677 345/213 |
| 2016/0335968 | A1* | 11/2016 | Zeng | G09G 3/3677 |
| 2018/0096646 | A1* | 4/2018 | Zeng | G09G 3/3688 |
| 2018/0218697 | A1* | 8/2018 | Zhang | G09G 3/3674 |

FOREIGN PATENT DOCUMENTS

| | | | |
|---|---|---|---|
| CN | 105304035 | A | 2/2016 |
| CN | 105390106 | A | 3/2016 |
| CN | 105810169 | A | 7/2016 |
| CN | 106448580 | A | 2/2017 |
| KR | 20170010221 | A | 1/2017 |

* cited by examiner

DRIVING METHOD AND DRIVING DEVICE OF DISPLAY PANEL

CROSS REFERENCE TO RELATED APPLICATIONS

This application is a national phase of PCT/CN2017/102436, filed on Sep. 20, 2017 and claims priority to Chinese Application No. 201710602429.1, filed on Jul. 21, 2017, which are hereby incorporated by reference in their entirely.

BACKGROUND

Technical Field

This disclosure relates to a display drive field, and more particularly to a driving method and a driving device of a display panel.

Related Art

Since liquid crystal display panels have many advantages, such as light weight, power saving and the like, they are widely used in televisions, mobile phone, digital cameras and other electronic products. With the development of technology, the requirements of the majority of consumers on the quality, appearance and the like are also getting higher and higher, and various manufacturers are continuously updating their own technology, such as narrow borders and so on. In order to continuously improve the competition ability of the product, reduce the cost of the product and so on, the development is also gradually moving toward the direction of the gate on array (GOA, also known as the gate driver on array, the array substrate line scan drive), and the GOA also becomes one mainstream of the liquid crystal panel.

The circuit operation of the common GOA requires the GOA timings of 8 clock signals or clocks (CKs). In the common GOA driving device, it is assumed that the circuit work of the GOA needs one start vertical (STV, a gate enable signal, that is, a start signal of one column, which is also a start signal of one frame), x CKs, two low clock (LC) or low frequency clock signals, and the timing-controller (T-CON) also needs to output one T_STV and x T_CKs, where x is to set and select based on the adaptive timing controllers according to requirements. For example, x is equal to 4, 8, 12 or other positive integers. This shows that when the clock signals get more, the T-CON output pins gets more, the circuit structure get more complex, and the drive structure needs a larger volume.

SUMMARY

Based on this, it is necessary to provide a driving method and a driving device of a display panel to solve the problems in improving the GOA drive, simplifying the connection structure, and optimizing the product design.

A driving method of a display panel comprises: controlling a timing controller to output a start signal to a level shifter; configuring a parameter of a register of the level shifter; and controlling the level shifter to generate a drive signal according to the parameter upon receiving the start signal, and outputting the drive signal to a first drive circuit.

The above-mentioned driving method configures the parameter of the register of the level shifter, so that the timing controller only needs to output the start signal to the level shifter, and the output pins of the timing controller can thus be reduced, the circuit structure can further be simplified, the volume of the drive product can be decreased, the thickness of the final product can be reduced, and the simplified timing controller can also be selected.

For example, the start signal is an STV signal. For example, the timing controller only outputs the STV signal to the level shifter. The above-mentioned driving method configures the parameter of the register of the level shifter, so that the timing controller only needs to output the STV signal to the level shifter, and the output pins of the timing controller can thus be reduced, the circuit structure can further be simplified, and the volume of the drive product can be decreased.

In one embodiment, the driving method, after the step of controlling the level shifter to generate the drive signal according to the parameter upon receiving the start signal, and outputting the drive signal to the first drive circuit, further comprises: controlling the first drive circuit to drive the display panel according to the drive signal.

For example, the first drive circuit is an array substrate row scan drive circuit.

In one embodiment, the step of configuring the parameter of the register of the level shifter comprises: acquiring the parameter of the register when the level shifter starts.

In one embodiment, the step of configuring the parameter of the register of the level shifter comprises: configuring the parameter of the register of the level shifter through an internal integrated circuit interface.

In one embodiment, in the step of configuring the parameter of the register of the level shifter, the parameter of the register of the level shifter comprises a delay time.

In one embodiment, in the step of configuring the parameter of the register of the level shifter, the parameter of the register of the level shifter further comprises a first level time, a cycle and a cycle count.

In one embodiment, the first level time is a high level time.

In one embodiment, the step of controlling the timing controller to output the start signal to the level shifter comprises: controlling the timing controller to only output the start signal to the level shifter.

In one embodiment, in the drive signal, a time from ending of a last clock signal to a next start signal is adopted as a vertical blank time.

A driving device of a display panel comprises a timing controller, a level shifter and a first drive circuit. The timing controller outputs a start signal to the level shifter. The level shifter configures a parameter of a register disposed in the level shifter, generates a drive signal according to the parameter upon receiving the start signal, and outputs the drive signal to a first drive circuit. The first drive circuit drives the display panel according to the drive signal.

The above-mentioned driving device configures the parameter of the register of the level shifter, so that the timing controller only needs to output the start signal to the level shifter, and the output pins of the timing controller can thus be reduced, the circuit structure can further be simplified, the volume of the drive product can be decreased, the thickness of the final product can be reduced, and the simplified timing controller can also be selected.

In one embodiment, the timing controller is only provided with an STV signal output pin, and the timing controller only outputs an STV signal to the level shifter.

A display device includes a display panel and a driving device of the above-mentioned display panel connected to the display panel.

In the above-mentioned display device, the timing controller is simpler, the circuit is also simpler, the drive structure can be made smaller, and the display device can be made thinner.

A driving method of a display panel comprises: controlling a timing controller to only output a start signal to a level shifter, wherein the timing controller is only provided with a gate enable signal output pin, and the timing controller only outputs the start signal to the level shifter through the gate enable signal output pin; configuring a parameter of a register of the level shifter, wherein the parameter of the register of the level shifter comprises a delay time, a high level time, a cycle and a cycle count; controlling the level shifter to generate a drive signal according to the parameter upon receiving the start signal, and outputting the drive signal to an array substrate row scan drive circuit; and controlling the array substrate row scan drive circuit to drive the display panel according to the drive signal.

In the above-mentioned driving method, the timing controller is only provided with an STV signal output pin, and the timing controller only outputs an STV signal to the level shifter, so that the circuit structure can further be simplified, and the volume of the drive product can be decreased.

DETAILED DESCRIPTION OF THE INVENTION

Specific structures and function details disclosed herein are only for the illustrative purpose for describing the exemplary embodiment of this disclosure. However, this disclosure can be specifically implemented through many replacements, and should not be explained as being restricted to only the embodiment disclosed herein.

In the description of this disclosure, when a first component is "fixed to" or "disposed on" a second component, the first component can be directly or indirectly fixed to or disposed on the second component. When a first component is "connected to" a second component, the first component can be directly or indirectly connected to the second component. In the description of this disclosure, the terms "vertical", "horizontal", "left", "right" and the likes are for illustrations and are not the only embodiment.

The terms used herein are for the purpose of describing only specific embodiments and are not intended to limit the exemplary embodiments. Unless the contexts clearly indicate otherwise, it should be understood that the terms "comprising" and/or "including" are used herein to describe the features to describe the presence of stated features, integers, steps, operations, units and/or elements without excluding the presence or addition of one or more other features, integers, steps, operations, units, elements, and/or combinations thereof.

Figure 1:
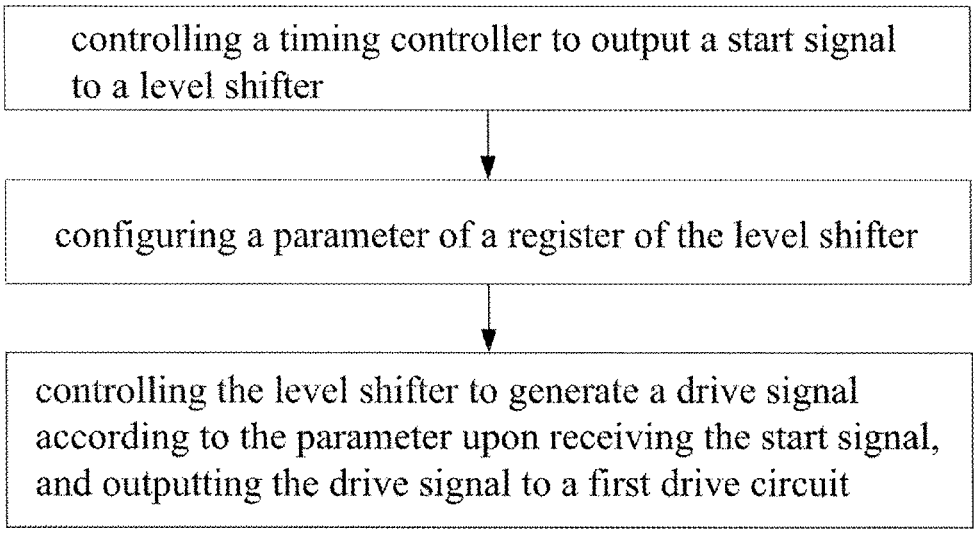
FIG. 1 is a schematic flow chart showing a driving method of an embodiment of this disclosure.

As shown in FIG. 1, in one embodiment of the disclosure, a driving method of a display panel comprises: controlling a timing controller to output a start signal to a level shifter; configuring a parameter of a register of the level shifter; and controlling the level shifter to generate a drive signal according to the parameter upon receiving the start signal, and outputting the drive signal to a first drive circuit. The above-mentioned driving method configures the parameter of the register of the level shifter, so that the timing controller only needs to output the start signal to the level shifter, and the output pins of the timing controller can thus be reduced, the circuit structure can further be simplified, the volume of the drive product can be decreased, the thickness of the final product can be reduced, and the simplified timing controller can also be selected.

For example, the start signal is an STV signal. For example, the first drive circuit is a GOA circuit. For example, the driving method of a display panel comprises: controlling the timing controller to output an STV signal to a level shifter; configuring a parameter of a register of the level shifter; and controlling the level shifter to generate a drive signal according to the parameter upon receiving the STV signal, and outputting the drive signal to a GOA circuit. For example, it will be appreciated that a level shifter generates a drive signal according to a parameter upon receiving a STV signal, the drive signal is a signal of a GOA circuit for driving a display panel, and the drive signal is outputted to an array substrate row scan drive circuit. The driving device configures the parameter of the register of the level shifter, so that the timing controller only needs to output the start signal to the level shifter, and the output pins of the timing controller can thus be reduced, the circuit structure can further be simplified, the volume of the drive product can be decreased, the thickness of the final product can be reduced, and the simplified timing controller can also be selected.

In one embodiment, after the step of controlling the level shifter to generate the drive signal according to the parameter upon receiving the start signal, and outputting the drive signal to the first drive circuit, the driving method further comprises: controlling the first drive circuit to drive the display panel according to the drive signal. For example, an array substrate row scan drive circuit drives the display panel according to the drive signal. For example, the driving method of a display panel comprises: controlling the timing controller to output an STV signal to a level shifter; configuring a parameter of a register of the level shifter; controlling the level shifter to generate a drive signal according to the parameter upon receiving the STV signal, and outputting the drive signal to an array substrate row scan drive circuit; and the array substrate row scan drive circuit driving the display panel according to the driving signal. That is, the STV signal and a parameter of a register configured in the level shifter are outputted according to the timing controller, and the GOA circuit drives the display panel. In this case, output pins of the timing controller are fewer, so that the circuit structure can further be simplified, and the volume of the drive product can be decreased.

Specifically, in this disclosure and each of its embodiments, a new drive and a new method are proposed for the GOA LCD TV panel, so that output pins of the T-CON can be reduced, the smaller T-CON integrated circuit (IC) can be selected, the circuit structure can be thus simplified, the display device can be made thinner, and the competition ability of the product can be enhanced.

As an example, in the driving method, controlling the timing controller to output the start signal to the level shifter may be controlling the timing controller to only output the STV signal to the level shifter. For example, the driving method of a display panel comprises: controlling the timing controller to output an STV signal to a level shifter; configuring a parameter of a register of the level shifter; and controlling the level shifter to generate a drive signal according to the parameter upon receiving the STV signal, and outputting the drive signal to an array substrate row scan drive circuit. In this case, the timing controller can be designed with only one output pin, a simplified timing controller can be thus selected and used, the volume of the timing controller itself is smaller, the structure is simpler, the circuit structure can further be simplified, the volume of the drive product can be decreased, the material usage of the timing controller can also be saved, and the cost can be thus reduced. It is understandable that the timing controller is adopted to only output the STV signal to the level shifter, and there will be extra requirements on the level shifter. Thus, the parameter of the register of the level shifter needs to be configured.

Figure 2:
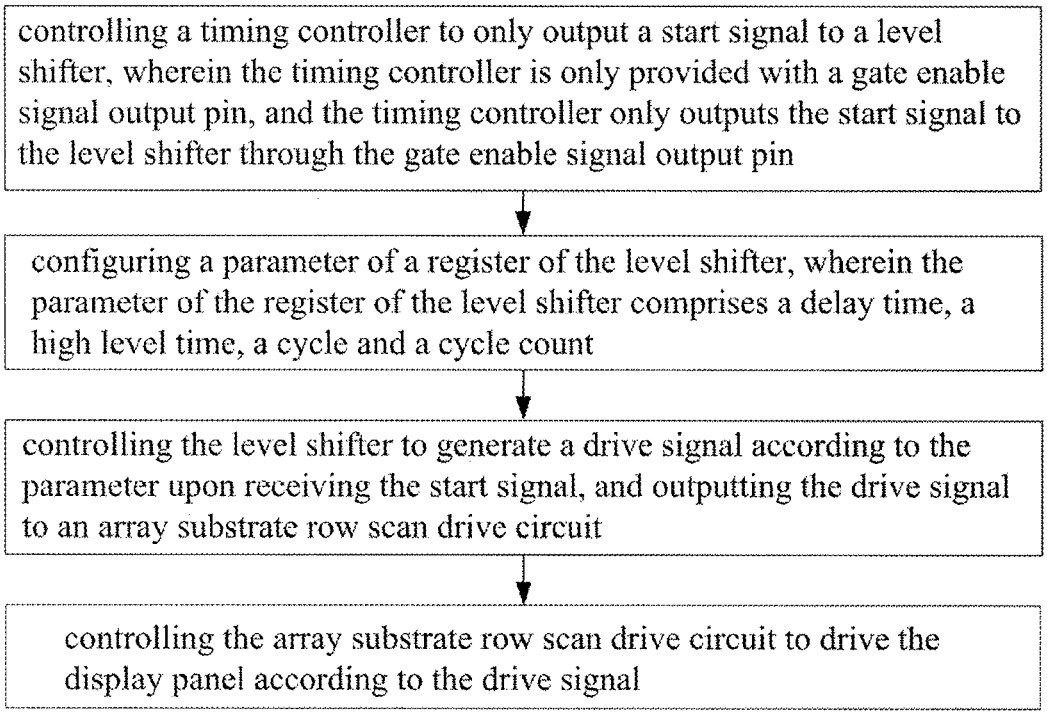
FIG. 2 is a schematic flow chart showing a driving method of another embodiment of this disclosure.

As shown in FIG. 2, in one example, the driving method of a display panel comprises: controlling a timing controller to only output a start signal to a level shifter, wherein the timing controller is only provided with a gate enable signal output pin, and the timing controller only outputs the start signal to the level shifter through the gate enable signal output pin; configuring a parameter of a register of the level shifter, wherein the parameter of the register of the level shifter comprises a delay time, a high level time, a cycle and a cycle count; controlling the level shifter to generate a drive signal according to the parameter upon receiving the start signal, and outputting the drive signal to an array substrate row scan drive circuit; and controlling the array substrate row scan drive circuit to drive the display panel according to the drive signal. In the above-mentioned driving method, the timing controller is only provided with an STV signal output pin, and the timing controller only outputs an STV signal to the level shifter, so that the circuit structure can further be simplified, and the volume of the drive product can be decreased.

In one embodiment, in the driving method, configuring the parameter of the register of the level shifter includes: acquiring the parameter of the register when the level shifter starts. For example, the level shifter acquires the parameter of the register when the level shifter is powered on. In one embodiment, in the driving method, configuring the parameter of the register of the level shifter includes: configuring the parameter of the register of the level shifter through an internal integrated circuit interface. For example, the parameter of the register of the level shifter is configured through an I2C interface, or other interfaces may also be used to configure the parameter of the register of the level shifter. For example, the parameter of the register of the level shifter includes several CK signals and several LC signals. In the driving method of one embodiment, in the step of configuring the parameter of the register of the level shifter, the parameter of the register of the level shifter includes a delay time. For example, in the step of configuring the parameter of the register of the level shifter, the parameter of the register of the level shifter includes a delay time, a first level time, a cycle and a cycle count, and each CK signal and/or each LC signal are/is determined according to the above-mentioned parameter. For example, the parameter of the register of the level shifter includes a delay time, a first level time, a cycle and a cycle count of each CK signal; and/or the parameter of the register of the level shifter includes a delay time, a first level time, a cycle and a cycle count of each LC signal. Alternatively, the parameter of the register of the level shifter includes a continuously time of the LC signal. For example, the parameter of the register of the level shifter includes a continuously time of each LC signal. For example, the first level time is a high level time, or the first level time is a low level time or a pre-defined level time. In the drive signal of one embodiment, a time from ending of a last clock signal to a next STV is adopted as a vertical blank (V blank) time. For example, the STV sends a high level trigger signal after an interval of the vertical blank time.

Figure 3:
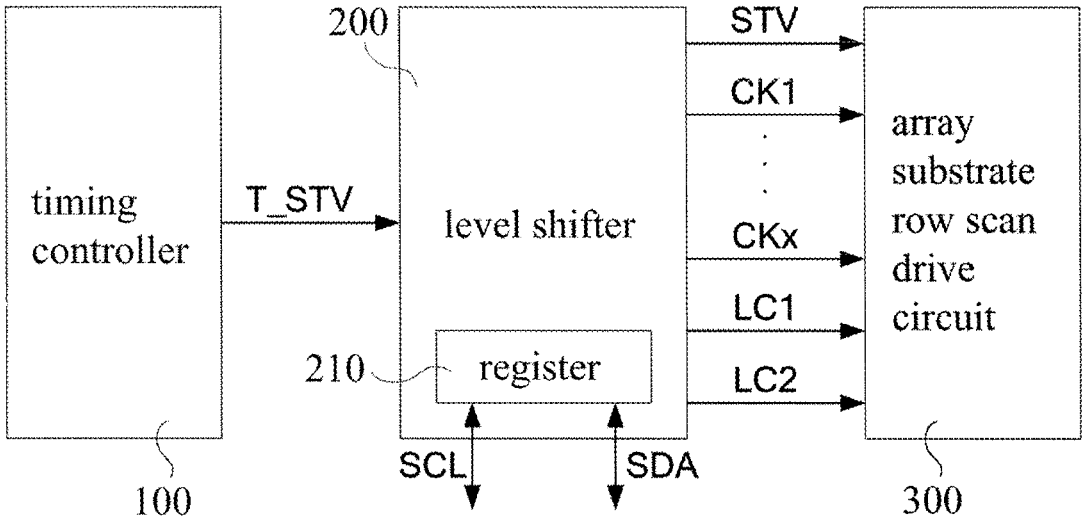
FIG. 3 is a schematic view showing a GOA driving device of an embodiment of this disclosure.

For example, a driving device of the display panel is newly proposed and shown in FIG. 3, wherein a timing controller (T-CON) 100 only needs to send the STV signal, a level shifter 200 retains an inter-integrated circuit (I2C) interface and a memory storing a setting of a register 210, the setting of the register is configured through the I2C interface, and the required STV, CK and LC signals are thus produced. The I2C interface is connected to the I2C bus (bidirectional two-wire synchronous serial communication bus). In the I2C bus, a serial bus consists of a data line SDA and a clock signal line SCL, and the I2C bus may send and receive data. For another example, the level shifter configures or stores several parameter sets, each of the parameter sets includes several parameters, the level shifter selects a parameter set and loads each of the parameters before receiving the STV signal or upon receiving a STV signal, and the drive signal of the GOA circuit is generated according to the parameters, and then outputted to an array substrate row scan drive circuit 300. For example, several parameters in each of the parameter sets include a delay time, a first level time, a cycle and a cycle count. For another example, several parameters in each of the parameter sets include several CK signals and several LC signals. For another example, several parameters in each of the parameter sets include parameters corresponding to several CK signals and several LC signals. For another example, several parameters in each of the parameter sets include a delay time, a first level time, a cycle and a cycle count corresponding to several CK signals and several LC signals, and so on.

Figure 4:
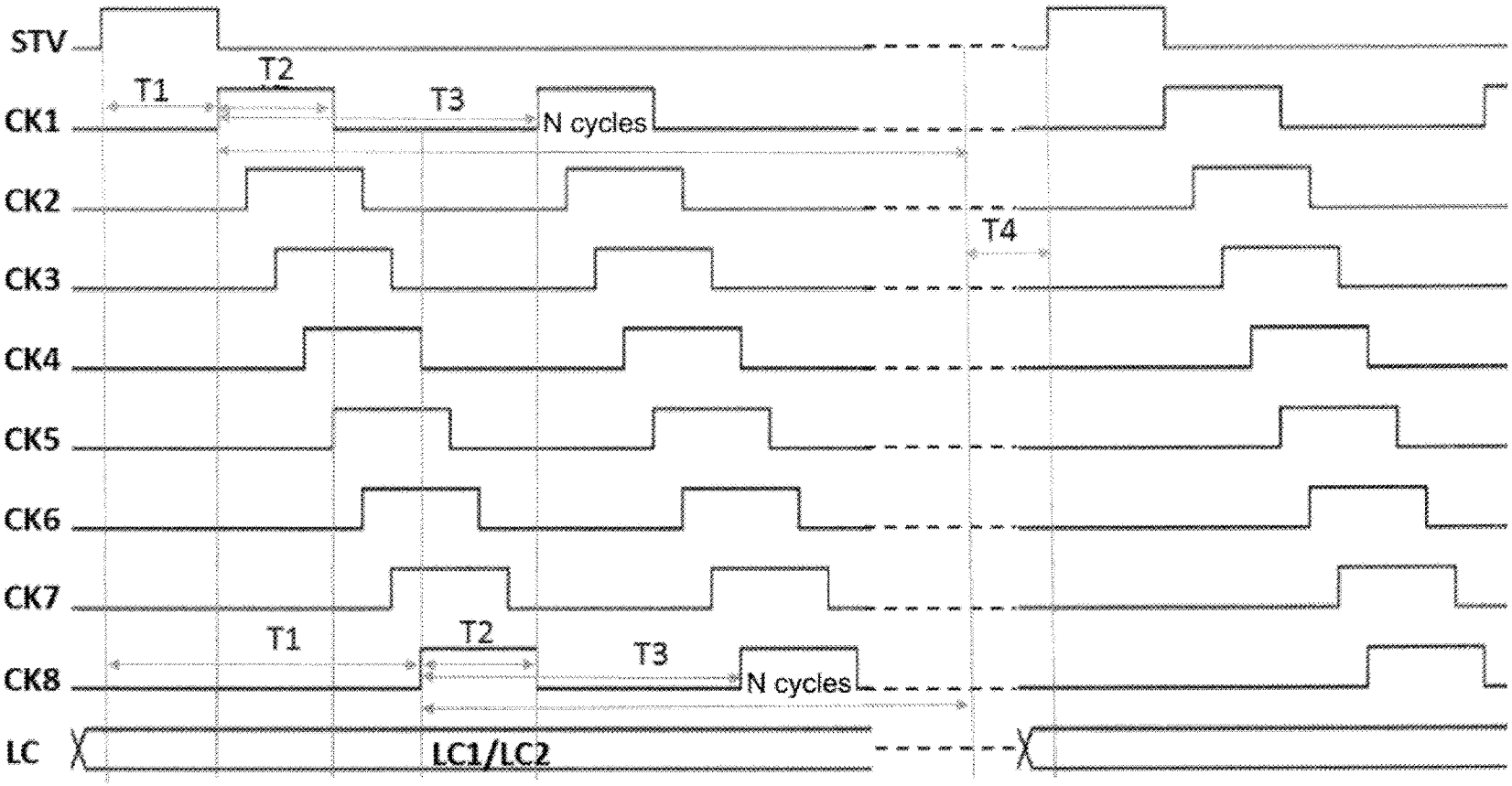
FIG. 4 is a schematic view illustrating settings of a register of an embodiment of this disclosure.

For example, as shown in FIG. 4, the settings of the register of the level shifter in the architecture are described. Taking the timings of the GOA of 8 CKs as an example, except that the STV is outputted directly through the level shifter, other signals may be configured by the register, which is configured with these four parameters, which are the Delay time (T1), the H level (T2), the cycle (T3) and the cycle count (N), as shown in the figure, to generate the CK and the LC signals outputted to the GOA. For example, only the four parameters of the register of the level shifter are configured. In addition, the time from ending of the last CK to the next STV (T5) is the V blank time. It will be appreciated that for the conventional technology, the T-CON needs to output 8 CKs, two LCs and one STV, and requires a total of 11 output pins. If the T-CON needs to output 16 CKs, then the T-CON requires a total of 19 output pins. As a result, the circuit structure is complex, the flat cable is limited, and the structure of the T-CON itself is complicated and has the higher cost.

However, by adopting this disclosure and each of its embodiments, the T-CON only needs to output one signal STV to the level shifter, the setting of the register of the level shifter is configured through the I2C interface, and the level shifter itself generates the drive signal needed by the GOA circuit, so that the number of pins of the T-CON is reduced, the structure of the T-CON itself is greatly simplified, the T-CON cost is thus saved, and the circuit structure and the flat cable are simplified.

For example, when the array substrate row scan drive circuit drives the display panel according to the drive signal, it also includes: dividing multiple pixel units of the display panel into several pixel unit sets, wherein each of the pixel unit sets includes three rows of continuously arranged pixel units; adopting drive voltages with the same polarity to drive two rows of adjacent pixel units of the three rows of continuously arranged pixel units; adopting drive voltages with opposite polarities to drive a first position sub-pixel and a second position sub-pixel of the same one of the pixel units; and adopting drive voltages with different voltage levels to respectively drive a sub-pixel of the first pixel unit and a sub-pixel of the second pixel unit; wherein the first pixel unit and the second pixel unit in the display panel are disposed adjacent to each other, as shown in FIGS. 7-10.

Figure 10:
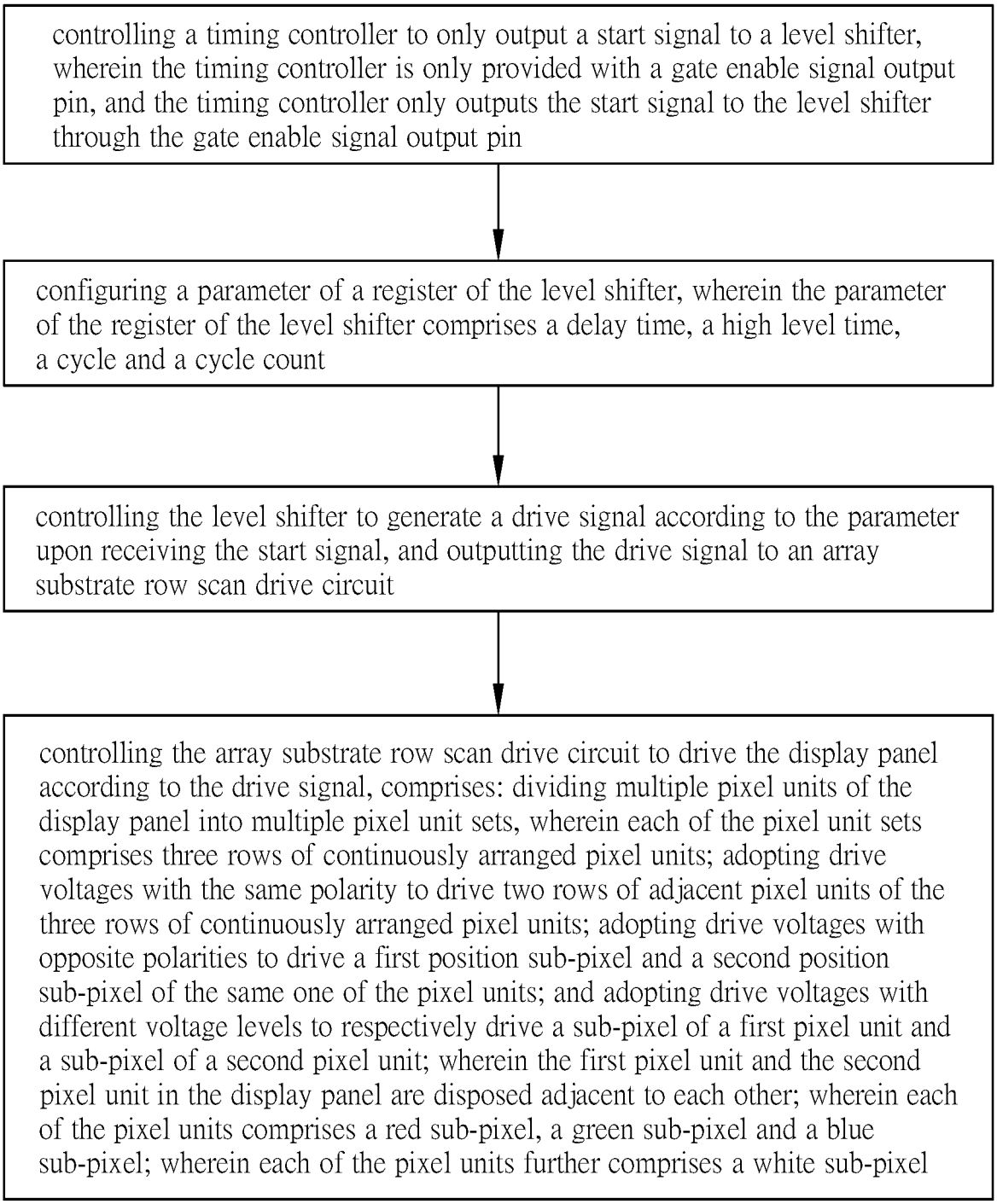
FIG. 10 is a schematic flow chart showing a driving method of another example of this disclosure.

For example, the display panel has multiple pixel units distributed in a matrix. For example, the display panel has several first pixel units and several second pixel units disposed adjacent to each other. In addition, each of the pixel units includes multiple sub-pixels. For example, as shown in FIG. 10, each of the pixel units at least includes a red sub-pixel, a green sub-pixel and a blue sub-pixel. Optionally, each of the pixel units may further include a white sub-pixel.

Figure 7:
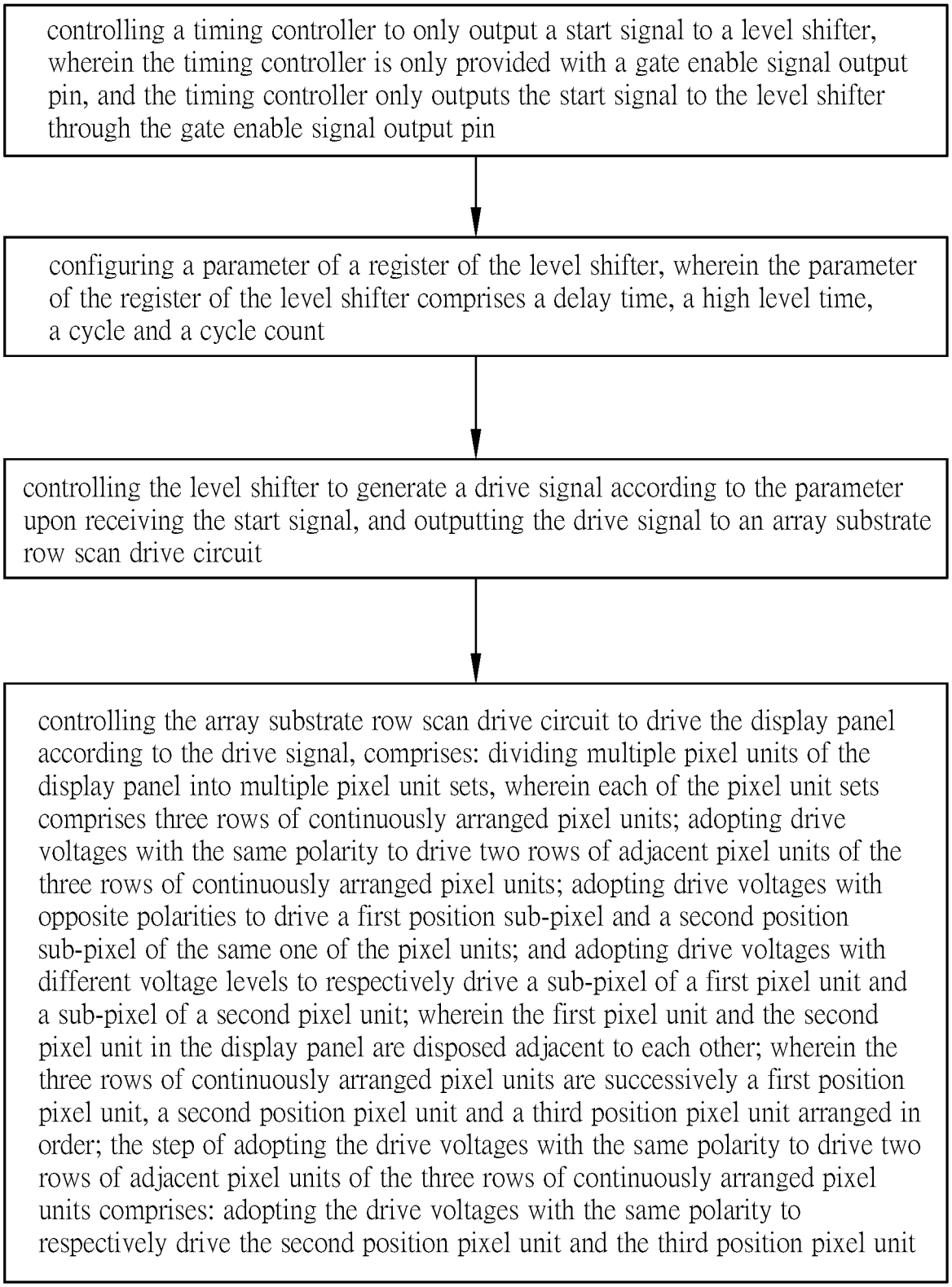
FIG. 7 is a schematic flow chart showing a driving method of an example of this disclosure.

For example, as shown in FIG. 7, the three rows of continuously arranged pixel units are successively a first position pixel unit, a second position pixel unit and a third position pixel unit arranged in order; the step of adopting the drive voltages with the same polarity to drive two rows of adjacent pixel units of the three rows of continuously arranged pixel units comprises: adopting the drive voltages with the same polarity to respectively drive the second position pixel unit and the third position pixel unit.

Figure 8:
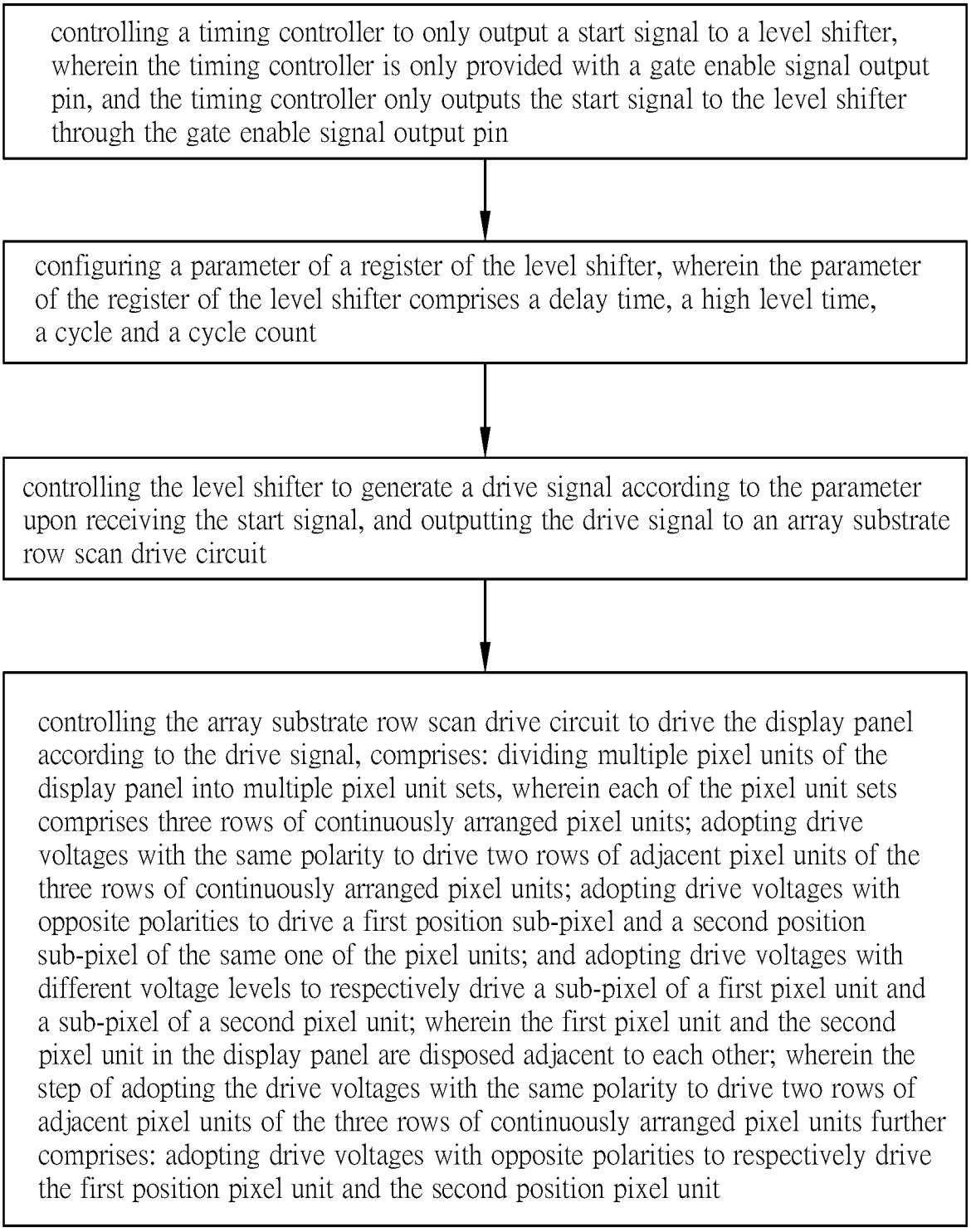
FIG. 8 is a schematic flow chart showing a driving method of another example of this disclosure.
Figure 9:
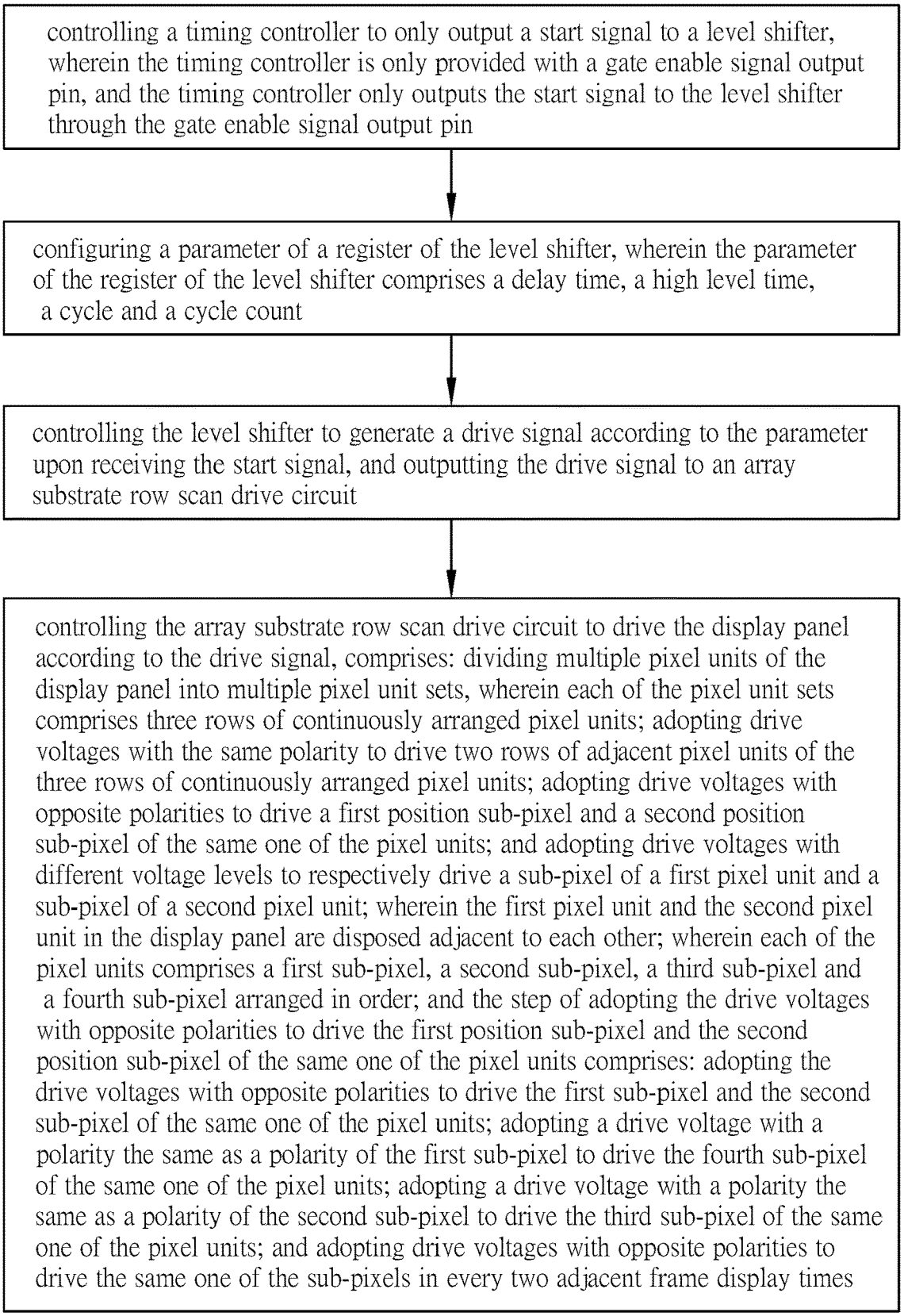
FIG. 9 is a schematic flow chart showing a driving method of another example of this disclosure.

For example, as shown in FIG. 8, the step of adopting the drive voltages with the same polarity to drive two rows of adjacent pixel units of the three rows of continuously arranged pixel units further comprises: adopting drive voltages with opposite polarities to respectively drive the first position pixel unit and the second position pixel unit. For example, as shown in FIG. 9, each of the pixel units comprises a first sub-pixel, a second sub-pixel, a third sub-pixel and a fourth sub-pixel arranged in order; and the step of adopting the drive voltages with opposite polarities to drive the first position sub-pixel and the second position sub-pixel of the same one of the pixel units comprises: adopting the drive voltages with opposite polarities to drive the first sub-pixel and the second sub-pixel of the same one of the pixel units; adopting a drive voltage with a polarity the same as a polarity of the first sub-pixel to drive the fourth sub-pixel of the same one of the pixel units; and adopting a drive voltage with a polarity the same as a polarity of the second sub-pixel to drive the third sub-pixel of the same one of the pixel units. For example, the driving method further includes: adopting drive voltages with opposite polarities to drive the same one of the sub-pixels in every two adjacent frame display times.

Thus, it is possible to equalize the number of sub-pixels, to which the positive-polarity high-voltage-level drive voltage is applied, to the number of sub-pixels, to which the negative-polarity high-voltage-level drive voltage, per column, so that the VCOM voltage is protected from parasitic capacitances, the correctness of the image signal is thus ensured, and the color shift or abnormal picture quality phenomenon is avoided.

In one embodiment of this disclosure, a timing controller is provides with the STV signal output pin to be connected to the level shifter. For example, the timing controller is only provided with an STV signal output pin. Through the provision of the STV signal output pin, the circuit structure of the above-mentioned timing controller can be simplified, a smaller timing controller can be manufactured, the material usage of the timing controller can also be saved, and the cost can be thus reduced.

Figure 5:
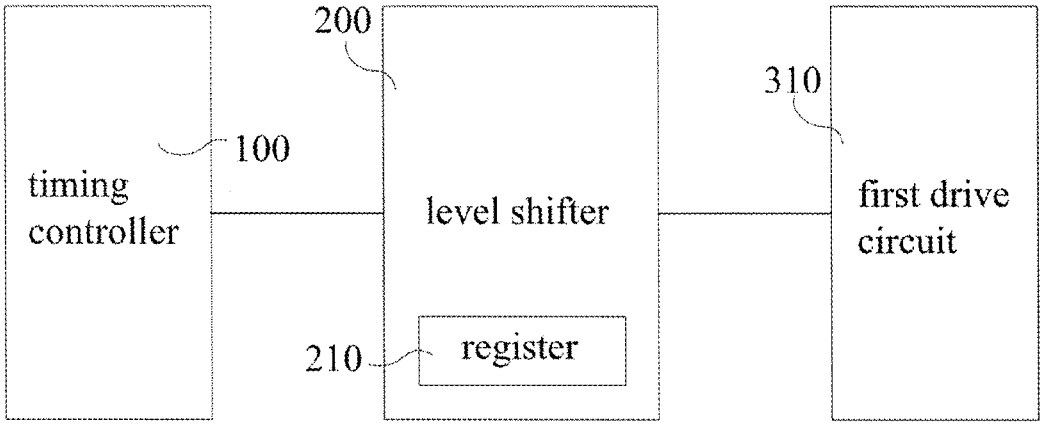
FIG. 5 is a schematic view showing a module of a driving device of an embodiment of this disclosure.

In one embodiment of this disclosure, as shown in FIG. 5, a driving device of a display panel includes a timing controller 100, a level shifter 200 and a first drive circuit 310. The timing controller 100 outputs a start signal to the level shifter 200. The level shifter 200 configures a parameter of a register 210 disposed in the level shifter 200, generating a drive signal according to the parameter upon receiving the start signal, and outputs the drive signal to the first drive circuit 310. The first drive circuit 310 drives the display panel according to the drive signal. For example, the start signal is the STV signal. For example, the first drive circuit is an array substrate row scan drive circuit. For example, the parameter of the register includes a delay time, a first level time, a cycle and a cycle count. For example, the first level time is a high level time. For example, a driving device of a display panel includes a timing controller, a level shifter and an array substrate row scan drive circuit. The timing controller outputs an STV signal to the level shifter. The level shifter configures a parameter of a register disposed in the level shifter, generating a drive signal of a GOA circuit according to the parameter upon receiving the STV signal, and outputs the drive signal to the array substrate row scan drive circuit. For example, a timing controller is provides with the STV signal output pin to be connected to the level shifter. For example, the timing controller is only provided with an STV signal output pin. For example, the driving device is implemented by adopting the driving method of any one of the above-mentioned embodiments.

In one embodiment, the timing controller is only provided with the STV signal output pin, and the timing controller only outputs the STV signal to the level shifter. For example, a driving device of a display panel is implemented by adopting the driving method of a display panel of any one of the above-mentioned embodiments. In addition, a driving device of a display panel has a function module related to the driving method of the display panel according to any one of the above-mentioned embodiments. For example, a driving device of a display panel has a function module for performing the driving method of the display panel according to any one of the above-mentioned embodiments. The driving device configures the parameter of the register of the level shifter, so that the timing controller only needs to output the start signal to the level shifter, and the output pins of the timing controller can thus be reduced, the circuit structure can further be simplified, the volume of the drive product can be decreased, the thickness of the final product can be reduced, and the simplified timing controller can also be selected.

Figure 6:
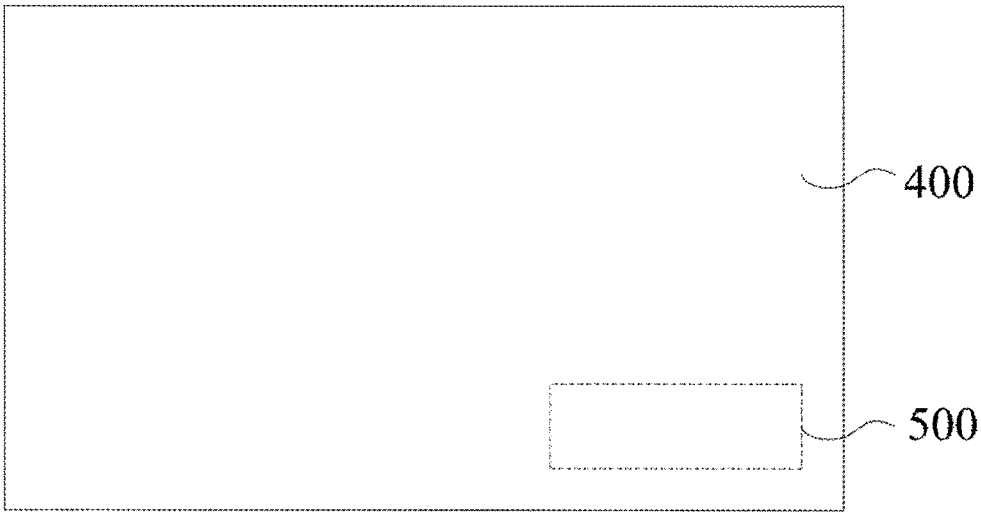
FIG. 6 is a schematic view showing a display device of an embodiment of this disclosure.

In one embodiment of this disclosure, as shown in FIG. 6, a display device includes a display panel 400 and a driving device 500 of the display panel of any one of the embodiments connected to the display panel. In one embodiment of this disclosure, a display device includes the driving device of the display panel of any one of the embodiments. For example, the display device is implemented by adopting the driving method of a display panel of any one of the embodiments. In one embodiment of this disclosure, the display device may be a television, a monitor or a portable display device. For example, the portable display device includes a wearable apparatus, a mobile phone, a tablet computer and/or a notebook computer and the like. For example, the display device includes the driving device of the display panel having the timing controller, the level shifter and the array substrate row scan drive circuit. For example, the television, monitor or portable display device includes a driving device of a display panel including a timing controller, a level shifter and an array substrate row scan drive circuit. For example, the timing controller is only provided with the STV signal output pin, and the timing controller only outputs the STV signal to the level shifter.

For example, the level shifter configures the parameter of the register of the level shifter through the I2C interface. For example, the parameter includes a delay time, a first level time, a cycle and a cycle count. In the above-mentioned display device, the timing controller is simpler, the circuit is simpler, the drive structure can be made smaller, and the display device can be made thinner.

In each embodiment, the display panel may be, for example but without limitation to, a liquid crystal display panel, and may also be an OLED or other display panels. The driving method of the display panel and the driving device of the display panel proposed by this disclosure may be applied to, for example, the ultra-high-definition display panel, in which the logic board drive of the full high definition display panel may be adopted.

The display panel is, for example, an LCD panel, an OLED display panel, a QLED display panel, a curved display panel, or any of other display panels.

When the display device is the liquid crystal display device, the liquid crystal display device may be a TN, an OCB, a VA or a curved type liquid crystal display device, but is not limited thereto. The liquid crystal display device may adopt a bottom lighting backlight source, which may be a white light source, a three-color (RGB) light source, a four-color (RGBW) light source or a four-color (RGBY) light source, but is not limited thereto.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a display panel, comprising:

controlling a timing controller to output a start signal to a level shifter;

configuring a parameter of a register of the level shifter;

controlling the level shifter to generate a drive signal according to the parameter upon receiving the start signal, and outputting the drive signal to a first drive circuit; and controlling the first drive circuit to drive the display panel according to the drive signal.

2. The driving method according to claim 1, wherein the first drive circuit is an array substrate row scan drive circuit.

3. The driving method according to claim 1, wherein the step of configuring the parameter of the register of the level shifter comprises: acquiring the parameter of the register when the level shifter starts.

4. The driving method according to claim 1, wherein in the step of configuring the parameter of the register of the level shifter, the parameter of the register of the level shifter comprises a delay time.

5. The driving method according to claim 4, wherein in the step of configuring the parameter of the register of the level shifter, the parameter of the register of the level shifter further comprises a first level time, a cycle and a cycle count.

6. The driving method according to claim 5, wherein the first level time is a high level time.

7. The driving method according to claim 1, wherein the step of controlling the timing controller to output the start signal to the level shifter comprises: controlling the timing controller to only output the start signal to the level shifter.

8. The driving method according to claim 7, wherein in the drive signal, a time from ending of a last clock signal to a next start signal is adopted as a vertical blank time.

9. A driving device of a display panel, comprising:

a timing controller outputting a start signal to a level shifter;

the level shifter configuring a parameter of a register disposed in the level shifter, generating a drive signal according to the parameter upon receiving the start signal, and outputting the drive signal to a first drive circuit; and the first drive circuit driving the display panel according to the drive signal.

10. The driving device according to claim 9, wherein the timing controller is only provided with a start signal output pin, and the timing controller only outputs the start signal to the level shifter.

11. A driving method of a display panel, comprising:

controlling a timing controller to only output a start signal to a level shifter, wherein the timing controller is only provided with a gate enable signal output pin, and the timing controller only outputs the start signal to the level shifter through the gate enable signal output pin;

configuring a parameter of a register of the level shifter, wherein the parameter of the register of the level shifter comprises a delay time, a high level time, a cycle and a cycle count;

controlling the level shifter to generate a drive signal according to the parameter upon receiving the start signal, and outputting the drive signal to an array substrate row scan drive circuit; and controlling the array substrate row scan drive circuit to drive the display panel according to the drive signal.

12. The driving method according to claim 11, wherein the step of controlling the array substrate row scan drive circuit to drive the display panel according to the drive signal comprises:

dividing multiple pixel units of the display panel into multiple pixel unit sets, wherein each of the pixel unit sets comprises three rows of continuously arranged pixel units;

adopting drive voltages with the same polarity to drive two rows of adjacent pixel units of the three rows of continuously arranged pixel units;

adopting drive voltages with opposite polarities to drive a first position sub-pixel and a second position sub-pixel of the same one of the pixel units; and adopting drive voltages with different voltage levels to respectively drive a sub-pixel of a first pixel unit and a sub-pixel of a second pixel unit;

wherein the first pixel unit and the second pixel unit in the display panel are disposed adjacent to each other.

13. The driving method according to claim 12, wherein the three rows of continuously arranged pixel units are successively a first position pixel unit, a second position pixel unit and a third position pixel unit arranged in order; the step of adopting the drive voltages with the same polarity to drive two rows of adjacent pixel units of the three rows of continuously arranged pixel units comprises: adopting the drive voltages with the same polarity to respectively drive the second position pixel unit and the third position pixel unit.

14. The driving method according to claim 12, wherein the step of adopting the drive voltages with the same polarity to drive two rows of adjacent pixel units of the three rows of continuously arranged pixel units further comprises: adopting drive voltages with opposite polarities to respectively drive the first position pixel unit and the second position pixel unit.

15. The driving method according to claim 12, wherein each of the pixel units comprises a first sub-pixel, a second sub-pixel, a third sub-pixel and a fourth sub-pixel arranged in order; and the step of adopting the drive voltages with opposite polarities to drive the first position sub-pixel and the second position sub-pixel of the same one of the pixel units comprises:

adopting the drive voltages with opposite polarities to drive the first sub-pixel and the second sub-pixel of the same one of the pixel units;

adopting a drive voltage with a polarity the same as a polarity of the first sub-pixel to drive the fourth sub-pixel of the same one of the pixel units; and adopting a drive voltage with a polarity the same as a polarity of the second sub-pixel to drive the third sub-pixel of the same one of the pixel units.

16. The driving method according to claim 15, further comprising:

adopting drive voltages with opposite polarities to drive the same one of the sub-pixels in every two adjacent frame display times.

17. The driving method according to claim 12, wherein each of the pixel units comprises a red sub-pixel, a green sub-pixel and a blue sub-pixel.

18. The driving method according to claim 17, wherein each of the pixel units further comprises a white sub-pixel.

* * * * *